US007310487B2

(12) United States Patent
Mizushima et al.

(10) Patent No.: US 7,310,487 B2
(45) Date of Patent: Dec. 18, 2007

(54) IMAGE FORMING APPARATUS WITH CONTROLLED TIMING OF CONTACT OF CLEANING BLADE AGAINST INTERMEDIATE TRANSFER MEMBER

(75) Inventors: Nobuyuki Mizushima, Nagano-ken (JP); Kuniaki Tanaka, Nagano-ken (JP); Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 11/266,003

(22) Filed: Nov. 2, 2005

(65) Prior Publication Data

US 2006/0120771 A1 Jun. 8, 2006

(30) Foreign Application Priority Data

Nov. 4, 2004 (JP) ..... P2004-320120
Nov. 4, 2004 (JP) ..... P2004-320121
Nov. 4, 2004 (JP) ..... P2004-320122
Nov. 4, 2004 (JP) ..... P2004-320123
Nov. 4, 2004 (JP) ..... P2004-320124

(51) Int. Cl.
*G03G 15/00* (2006.01)
*G03G 15/14* (2006.01)
*G03G 21/00* (2006.01)

(52) U.S. Cl. ..... 399/101; 399/45; 399/71; 399/302

(58) Field of Classification Search ..... 399/71, 399/101, 16, 68, 45, 302, 308
See application file for complete search history.

(56) References Cited

U.S. PATENT DOCUMENTS 5,652,948 A * 7/1997 Sakaguchi et al. ..... 399/302 X
5,828,926 A * 10/1998 Iwata et al. ..... 399/71 X
6,823,166 B2 * 11/2004 Nishiwaki ..... 399/101 X
2003/0118379 A1 6/2003 Hattori ..... 399/297
2005/0100361 A1 * 5/2005 Tanaka et al. ..... 399/101

FOREIGN PATENT DOCUMENTS

JP 09-146438 6/1997
JP 2000-066529 3/2000
JP 2001-147573 5/2001
JP 2003-195712 7/2003

* cited by examiner

*Primary Examiner*—Sophia S. Chen
(74) *Attorney, Agent, or Firm*—Hogan & Hartson LLP

(57) ABSTRACT

A circulating intermediate transfer member contacts an image carrier at a primary transfer position at which a toner image is transferred onto the intermediate transfer member. A secondary transfer member contacts the intermediate transfer member at a secondary transfer position at which the toner image is transferred onto a recording medium. A gate roller pair nips the recording medium therebetween at a nipping position and conveys the recording medium toward the secondary transfer position. A cleaning blade retractably contacts and scrapes off toner remaining on the intermediate transfer member. A conveyance speed of the recording medium at the nipping position is faster than that at the secondary transfer position. The cleaning blade is retracted from the intermediate transfer member until a trailing end of the recording medium passes through the nipping position, when the recording medium has a stiffness greater than a prescribed level.

5 Claims, 5 Drawing Sheets

IMAGE FORMING APPARATUS WITH CONTROLLED TIMING OF CONTACT OF CLEANING BLADE AGAINST INTERMEDIATE TRANSFER MEMBER

BACKGROUND OF THE INVENTION

The present invention relates to an image forming apparatus such as a printer, a facsimile machine, and a copying machine that forms a toner image using electrophotography.

Japanese Patent Publication No. 2003-195712A discloses an image forming apparatus that comprises:

an image carrier on which a toner image is formed;

an intermediate transfer member for forming a primary transfer position contacting the image carrier so as to perform primary transfer of the toner image on the image carrier, and then forming a secondary transfer position contacting a recording medium so as to transfer the toner image onto the recording medium;

a secondary transfer roller brought into press contact with the intermediate transfer member via the recording medium at the secondary transfer position;

a gate roller pair arranged in an immediate vicinity of a preceding stage of the secondary transfer position relative to a direction of conveyance of the recording medium, and thereby conveying the recording medium toward the secondary transfer position;

a cleaning blade retractably brought into contact with the intermediate transfer member to scrape off residual toner remaining on the intermediate transfer member after the secondary transfer; and a fuser for allowing the recording medium onto which the toner image has been transferred at the secondary transfer position to pass therethrough, and thereby fusing the toner image onto the recording medium.

In such an image forming apparatus, if the cleaning blade would be brought into contact with the intermediate transfer member during the above-mentioned primary transfer, a vibration in the apparatus arising at the time of contact of the cleaning blade or a change in the moving load of the intermediate transfer member could easily cause deviation or distortion in the obtained image.

In order to resolve such a problem, in the image forming apparatus, regardless of the thickness of the recording medium, it is configured that the cleaning blade is brought into contact with the intermediate transfer member in a time duration that primary transfer is not performed.

In general, in an image forming apparatus as described above, the conveyance speed of the recording medium caused by the gate roller pair is preferably set to be faster than the conveyance speed of the recording medium at the secondary transfer position. This is because if the conveyance speed of the recording medium caused by the gate roller pair in the immediate vicinity of the preceding stage of the secondary transfer position were equal to or slower than the conveyance speed of the recording medium at the secondary transfer position, a tension could act on the recording medium when the recording medium is located between the gate roller pair and the secondary transfer position described above. Then, this tension could serve as a load at the secondary transfer position, and thereby could cause instability in the transfer operation at the secondary transfer position (deviation or distortion could arise in the transferred image).

In contrast, when, the conveyance speed of the recording medium caused by the gate roller pair is set to be faster than the conveyance speed of the recording medium at the secondary transfer position, the above-mentioned tension does not act. Thus, when the recording medium has a thickness at or below that of an ordinary sheet (a sheet stiffness), no problem arises from the above-mentioned tension.

Nevertheless, in the case that the recording medium conveyed by the gate roller pair and the secondary transfer position described above is a thick sheet, a compressive force acts on the thick sheet located between the gate roller pair and the secondary transfer position. This compressive force acts such as to increase the traveling speed of the intermediate transfer member at the secondary transfer position, and hence tends to cause instability in the traveling speed of the intermediate transfer member.

Thus, in such a situation, when the cleaning blade is brought into contact with the intermediate transfer member, the traveling speed of the intermediate transfer member becomes more unstable so that the speed fluctuation increases. This easily causes deviation or distortion in the image under the primary transfer in the above-mentioned primary transfer position.

Irrespective of the thickness of the recording medium, similar problem would arise in the case of a recording medium having a large stiffness that is enough to cause an increase in the traveling speed of the intermediate transfer member at the secondary transfer position and thereby causes an instability in the traveling speed of the intermediate transfer member. Thus, in the present application, a "thick sheet" indicates a "recording medium having a large sheet stiffness that is enough to cause an increase in the traveling speed of the intermediate transfer member at the secondary transfer position and thereby causes an instability in the traveling speed of the intermediate transfer member."

Nevertheless, in order that the cleaning blade is bought into contact with the intermediate transfer member in a time duration that primary transfer is not performed, in other words, in order that primary transfer is not performed when the cleaning blade comes in contact with the intermediate transfer member, spacing need be increased between the formed images. Then, if the spacing were increased between the formed images, this would reduce the achievable number of achievable image formations per unit time.

In the apparatus described above, since the cleaning blade is brought into contact with the intermediate transfer member in a time duration that primary transfer is not performed, regardless of the thickness of the recording medium, the achievable number of achievable image formations per unit time is reduced for the recording medium of every thickness.

SUMMARY OF THE INVENTION

It is therefore an object of the present invention to provide an image forming apparatus in which deviation or distortion hardly occurs in an image under primary transfer even when a recording medium is a thick sheet, while preventing the number of achievable image formation per unit time from being decreased when the recording medium is an ordinary sheet.

In order to achieve the above object, according to the invention, there is provided an image forming apparatus, comprising:

an image carrier, adapted to support a toner image thereon;

a circulating intermediate transfer member, brought into contact with the image carrier to form a primary transfer position at which the toner image is transferred onto the intermediate transfer member to perform a primary transfer;

a secondary transfer member, brought into contact with the intermediate transfer member to form a secondary transfer position at which the toner image on the intermediate transfer member is transferred onto a recording medium passing therebetween, to perform a secondary transfer;

a gate roller pair, adapted to nip the recording medium therebetween at a nipping position and to convey the nipped recording medium toward the secondary transfer position; and a cleaning blade, retractably brought into contact with the intermediate transfer roller to scrape off toner remaining on the intermediate transfer roller, wherein:

a conveyance speed of the recording medium at the nipping position is faster than a conveyance speed of the recording medium at the secondary transfer position; and the cleaning blade is retracted from the intermediate transfer member until when a trailing end of the recording medium passes through the nipping position, in a case where the recording medium has a stiffness greater than a prescribed level.

With this configuration, since the conveyance speed of the recording medium caused by the gate roller pair is set to be faster than the conveyance speed of the recording medium at the secondary transfer position, no tension acts on the recording medium between the gate roller pair and the secondary transfer position. Thus, when the recording medium has a stiffness no greater than the prescribed level, the transfer operation at the secondary transfer position becomes stable so that deviation or distortion does not occur in the image under the secondary transfer. Further, the circulating speed of the intermediate transfer member also becomes stable so that deviation or distortion is avoided similarly in the image at the primary transfer position.

Further, when the recording medium has a stiffness greater than the prescribed level, the cleaning blade is brought into contact with the intermediate transfer member after the trailing edge of the recording medium has passed the nipping position. Thus, at the time that the cleaning blade is brought into contact with the intermediate transfer member, a state is already established that a speed increasing force resulting from a compressive force does not act on the intermediate transfer member. Accordingly, at the time that the cleaning blade is brought into contact with the intermediate transfer member, the traveling speed of the intermediate transfer member is in a stable state.

Thus, even when the cleaning blade is brought into contact with the intermediate transfer member, no large fluctuation arises in the circulating speed of the intermediate transfer member. As a result, deviation or distortion hardly occurs in the image under the primary transfer at the primary transfer position.

The cleaning blade may be retracted from the intermediate transfer member until when the primary transfer is finished, in a case where the recording medium has a stiffness greater than the prescribed level.

In this case, at the time that the cleaning blade is brought into contact with the intermediate transfer member, the primary transfer is already completed. Thus, even when the cleaning blade is brought into contact with the intermediate transfer member, deviation or distortion hardly occurs in the image under the primary transfer at the primary transfer position.

The image forming apparatus may further comprise a fuser, disposed at a fusing position and adapted to allow the recording medium on which the toner image has been transferred to pass through while fusing the toner image with the recording medium. The circulating speed of the intermediate transfer member while the secondary transfer is performed and a conveyance speed of the recording medium at the fusing position may be made lower, in a case where the recording medium has a stiffness greater than the prescribed level, than in a case where the recording medium has a stiffness no greater than the prescribed level.

This permits reliable fusing of the toner image onto the recording medium without the necessity of an increase in the heat generation rate of the fuser. Further, using the time duration that the recording medium and the intermediate transfer member are at low speeds, the cleaning blade can be brought into contact with the intermediate transfer member 51 after the primary transfer is completed. On the other hand, in a case where the recording medium has a stiffness no greater than the prescribed level, the number of achievable image formations per unit time can be maintained at a high rate.

According to the invention, there is also provided an image forming apparatus, comprising:

an image carrier, adapted to support a toner image thereon;

a circulating intermediate transfer member, brought into contact with the image carrier to form a primary transfer position at which the toner image is transferred onto the intermediate transfer member to perform a primary transfer;

a secondary transfer member, brought into contact with the intermediate transfer member to form a secondary transfer position at which the toner image on the intermediate transfer member is transferred onto a recording medium passing therebetween, to perform a secondary transfer;

a gate roller pair, adapted to nip the recording medium therebetween at a nipping position and to convey the nipped recording medium toward the secondary transfer position; and a cleaning blade, retractably brought into contact with the intermediate transfer roller to scrape off toner remaining on the intermediate transfer roller, wherein:

a conveyance speed of the recording medium at the nipping position is faster than a conveyance speed of the recording medium at the secondary transfer position; and the cleaning blade is retracted from the intermediate transfer member until when the primary transfer is finished, only in a case where the recording medium has a stiffness greater than a prescribed level.

The image forming apparatus may further comprise a fuser, disposed at a fusing position and adapted to allow the recording medium on which the toner image has been transferred to pass through while fusing the toner image with the recording medium. The circulating speed of the intermediate transfer member while the secondary transfer is performed and a conveyance speed of the recording medium at the fusing position may be made lower, in a case where the recording medium has a stiffness greater than the prescribed level, than in a case where the recording medium has a stiffness no greater than the prescribed level.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
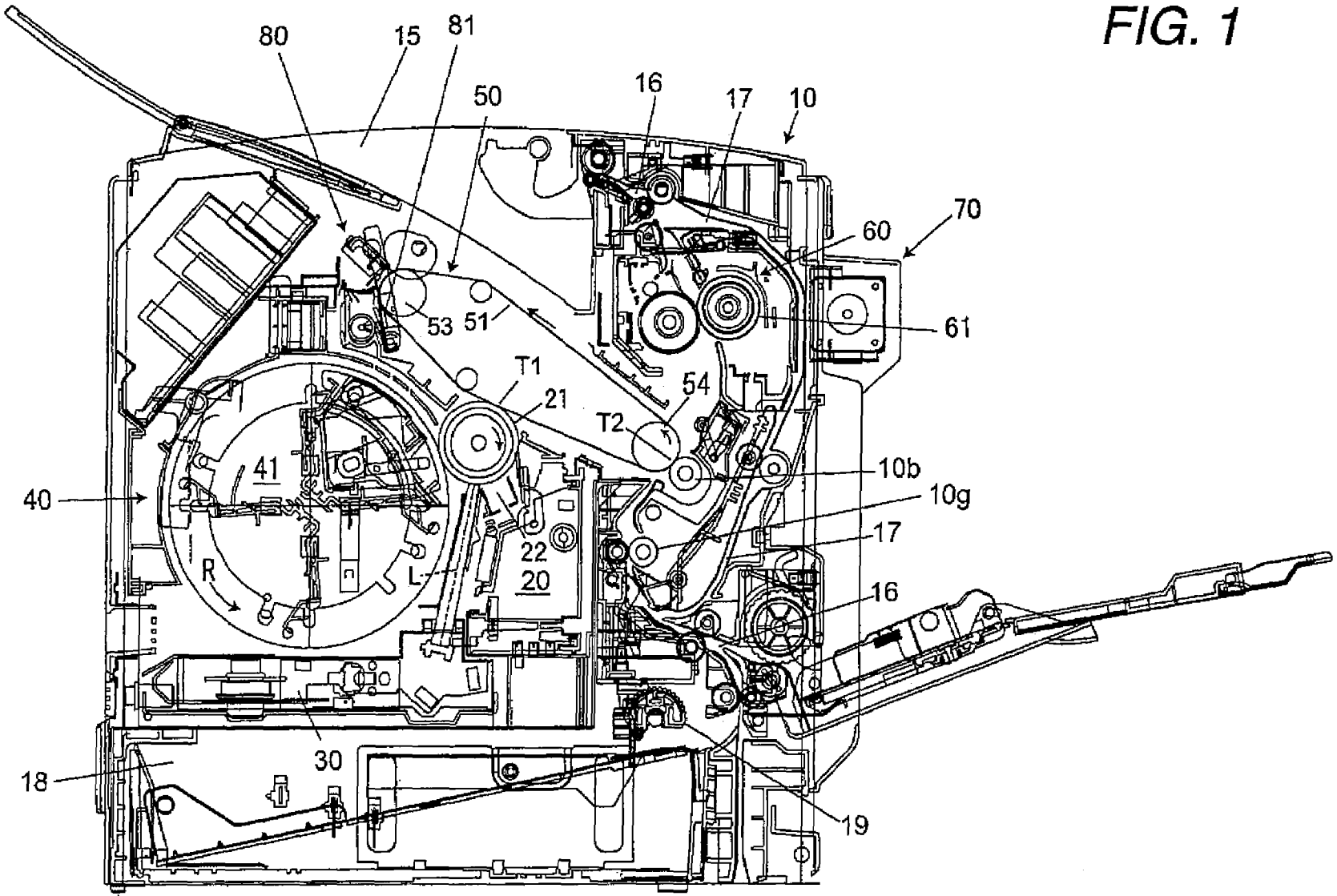
FIG. 1 is a section view showing an internal structure of an image forming apparatus according to one embodiment of the invention.

FIG. 1 shows an image forming apparatus according to one embodiment of the invention.

This image forming apparatus is adapted to longitudinally feed a sheet of A4 size (including the letter size) as a recording medium and then to form a full color image on both sides of the recording medium. The image forming apparatus comprises: a case 10; an image carrier unit 20 accommodated in the case 10; an exposure unit 30; a development unit 40; an intermediate transfer unit 50; and a fuser unit 60.

In the case 10, a frame of the main body of the apparatus is provided but not shown. Then, various units and the like are attached to this frame.

The image carrier unit 20 comprises: a photosensitive body 21 having a photosensitive layer in its outer periphery surface and thereby serving as an image carrier; and a corona electrostatic charger (scorotron electrostatic charger) 22 for electrostatically charging the outer periphery surface of the photosensitive body 21 uniformly. Then, selective exposure with laser light L from the exposure unit 30 is performed on the outer periphery surface of the photosensitive body 21 uniformly charged by the corona electrostatic charger 22, so that an electrostatic latent image is formed. After that, toner serving as a developer agent is imparted to the electrostatic latent image in the development unit 40, so that the image is converted into a visible image (toner image). This toner image is primarily transferred, at a primary transfer position T1, onto an intermediate transfer belt 51 serving as an intermediate transfer member of the intermediate transfer unit 50. After that, in a secondary transfer position T2, the image is secondarily transferred onto a recording medium.

The inside of the case 10 is provided with: a conveyance path 16 along which a sheet having an image formed on one side by the above-mentioned secondary transfer position T2 is conveyed toward a sheet ejecting section (ejection tray) 15 in the upper face of the case 10; and a return path 17 along which the sheet conveyed toward the sheet ejecting section 15 along the conveyance path 16 is switched back and returned toward the secondary transfer position T2 in order that an image should be formed also on the other surface of the recording medium.

Reference Numeral 70 denotes a double-side image formation unit arranged in a manner attachable to and detachable from the main body of the apparatus. When this double-side image formation unit 70 is attached, the return path 17 is formed.

In a lower part of the case 10, a sheet cassette 18 is provided for stacking and retaining sheets of recording media. Further, a feeding roller 19 is provided for feeding each sheet S (see FIG. 2) toward the above-mentioned secondary transfer position T2. The timing of conveyance to the secondary transfer position T2 is controlled by a gate roller pair 10*g* so that the sheet fed by the feeding roller 19 is conveyed toward the secondary transfer position T2 by the gate roller pair 10*g*.

The development unit 40 is a rotary unit, in which a plurality of cartridges containing toner for K (black), C (cyan), M (magenta), and Y (yellow) are detachably arranged in a rotor body 41. When the rotor body 41 rotates in a 90° pitch in the direction of an arrow R, a developing roller (not shown) provided in each cartridge is brought into contact with the photosensitive body 21 selectively. Thus, the surface of the photosensitive body 21 can be developed selectively.

The exposure unit 30 irradiates the photosensitive body 21 with the laser light beam L.

The intermediate transfer unit 50 comprises: a body frame which is not shown; and the intermediate transfer belt 51 wound and tensioned around a driving roller 54, a plurality of follower rollers 53, and the like supported rotatably in the frame. The intermediate transfer belt 51 is driven and circulated in the direction of an arrow in the figure. A contacting part between the photosensitive body 21 and the intermediate transfer belt 51 forms the primary transfer position T1, while a pressure contacting part between the driving roller 54 and the secondary transfer roller 10*b* provided in the main body forms the secondary transfer position T2.

The secondary transfer roller 10*b* is retractably brought into contact with the intermediate transfer belt 51 to form the secondary transfer position T2.

Thus, in the formation of a color image, a plurality of toner images are overlaid on the intermediate transfer belt 51 in a state that the secondary transfer roller 10*b* is retracted from the intermediate transfer belt 51, so that a color image is formed. After that, the secondary transfer roller 10*b* is brought into contact with the intermediate transfer belt 51, while a recording medium S is provided to the secondary transfer position T2, so that the color image (toner image) is transferred from the intermediate transfer belt 51 onto the recording medium S to perform the secondary transfer.

The sheet onto which the toner image has been transferred passes through the fuser unit 60, so that fusing of the toner image with respect to the recording medium S is performed. Then, the recording medium S is ejected toward the above-mentioned ejection tray 15.

The intermediate transfer unit 50 is provided with a cleaner unit 80 for removing residual toner remaining on the intermediate transfer belt 51 after the secondary transfer.

In the cleaner unit 80, a cleaning blade 81 is so arranged to be retractably brought into contact with the surface of the intermediate transfer belt 51 by an actuator 83. The cleaning blade 81 brought into contact with the intermediate transfer member 51 scrapes off residual toner remaining on the intermediate transfer member 51 after the secondary transfer.

Figure 2:
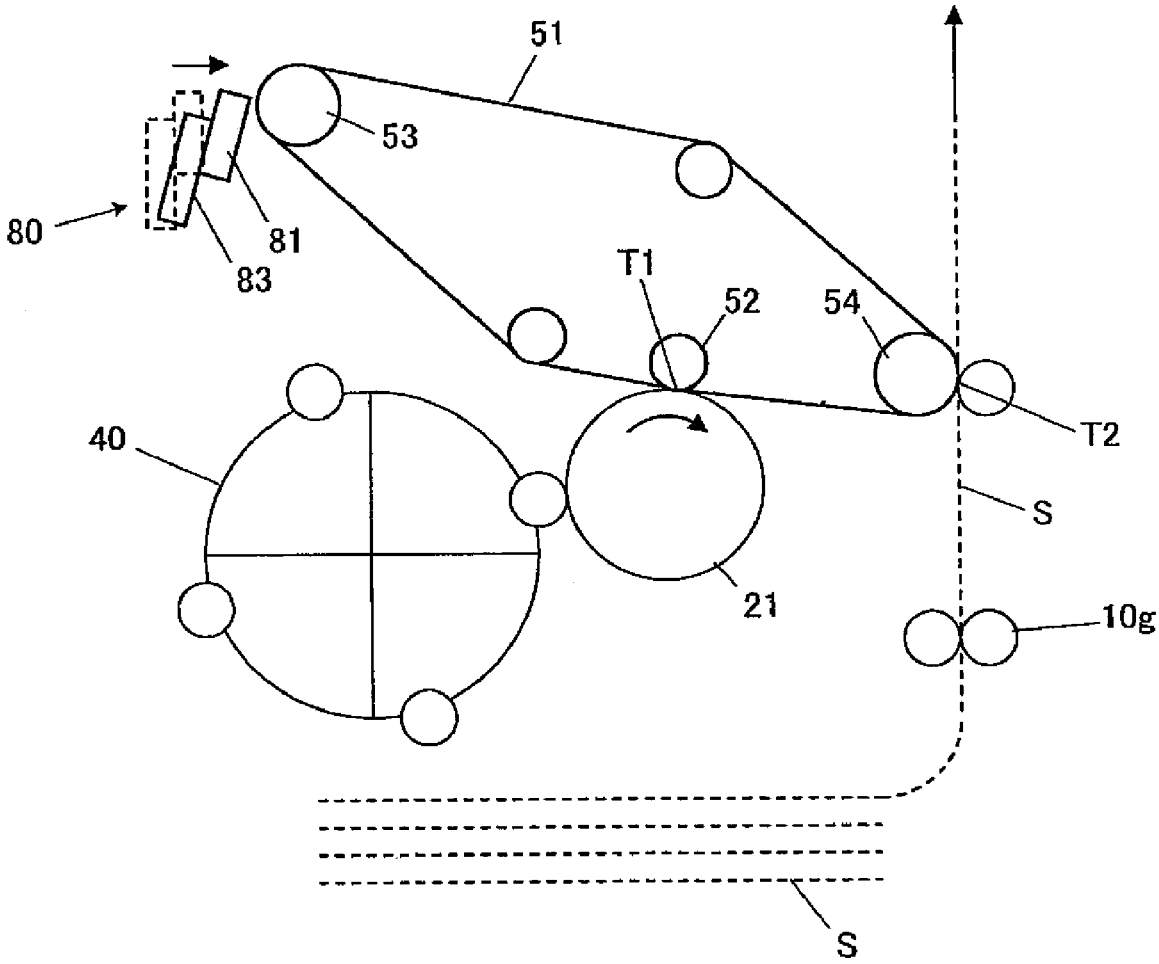
FIG. 2 is a schematic view showing a main part of the image forming apparatus.

As shown in FIGS. 1 and 2, the gate roller pair 10*g* constitutes a gate roller pair arranged in the immediate vicinity of the preceding stage of the secondary transfer position T2 relative to the direction of conveyance of the recording medium S, and thereby conveying the recording medium S toward the secondary transfer position T2.

Figure 3:
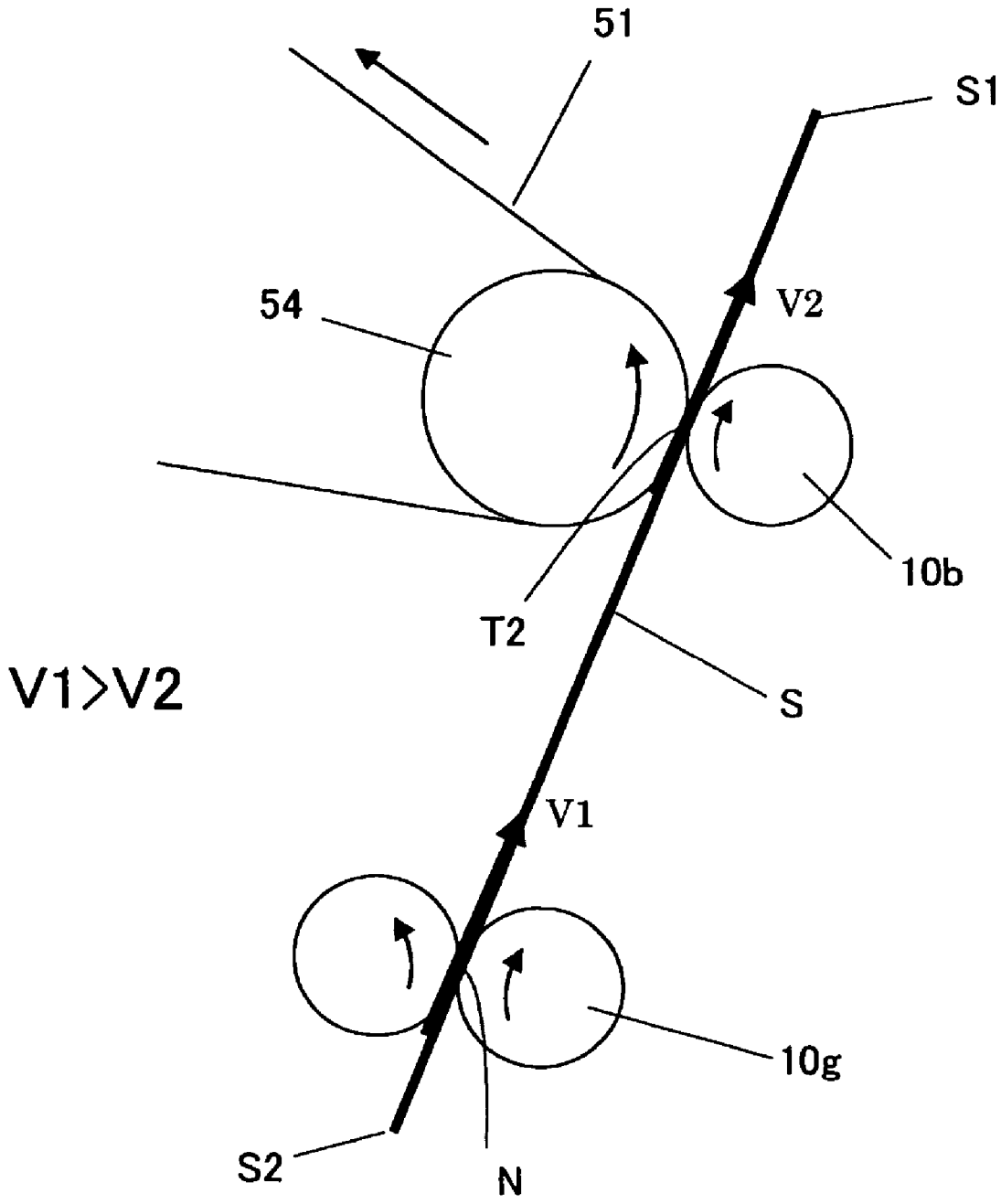
FIG. 3 is a schematic view showing a gate roller pair and a secondary transfer position in the image forming apparatus.

As shown in FIG. 3, the conveyance speed V1 of the recording medium S caused by the gate roller pair 10*g* is set to be faster than the conveyance speed V2 of the recording medium S at the secondary transfer position T2.

As shown in FIG. 2, a backup roller 52 is brought into contact with a back face of the intermediate transfer belt 51 at the primary transfer position T1. Such a roller may be omitted.

When the backup roller is not provided as shown in FIG. 1, the photosensitive body 21 is brought into contact with the intermediate transfer belt 51 at the primary transfer position T1 by the tension of the intermediate transfer belt 51.

The timing that the cleaning blade 81 is brought into contact with the intermediate transfer belt 51 is controlled by a controller (not shown) for controlling the operation of the entire image forming apparatus.

In general, this image forming apparatus is used in a manner connected to a personal computer.

Classification such as the size and the thickness of the sheet (recording medium) S supplied for the image formation in the image forming apparatus may be set up through an operation panel provided in the image forming apparatus. However, in general, such set up is performed on the personal computer, so that the setting information is inputted to the above-mentioned controller of the image forming apparatus.

Specifically, when the recording material S is a thick paper sheet (or a rigid recording material such as an envelope and an OHP sheet), the controller activates the actuator 83 for the cleaning blade 81 such as to bring the cleaning blade 81 into contact with the intermediate transfer belt 51 after the primary transfer is completed and after a trailing edge S2 (see FIG. 3) of the recording medium S has passed the nipping part N of the gate roller pair 10*g*.

When the size of the recording material S is known, the time point that a leading edge S1 of the recording medium S enters into the nipping part N of the gate roller pair 10*g* and then the trailing edge S2 of the recording material S passes the nipping part N can be detected from the number of revolutions of the gate roller pair 10*g* or the like (or, for example, the number of driving steps for a stepping motor for driving the gate roller pair 10*g*). Thus, on the basis of the number of driving steps for the stepping motor or the like, the controller activates the actuator 83 for the cleaning blade 81 such as to bring the cleaning blade 81 into contact with the intermediate transfer belt 51 after the trailing edge S2 of the recording material has passed the nipping part N of the gate roller pair 10*g*.

Alternatively, only when the recording medium S is a thick sheet (or a rigid recording medium such as an envelope and an OHP sheet), the controller activates the actuator 83 for the cleaning blade 81 such as to bring the cleaning blade 81 into contact with the intermediate transfer belt 51 after the primary transfer is completed.

Figure 4A:
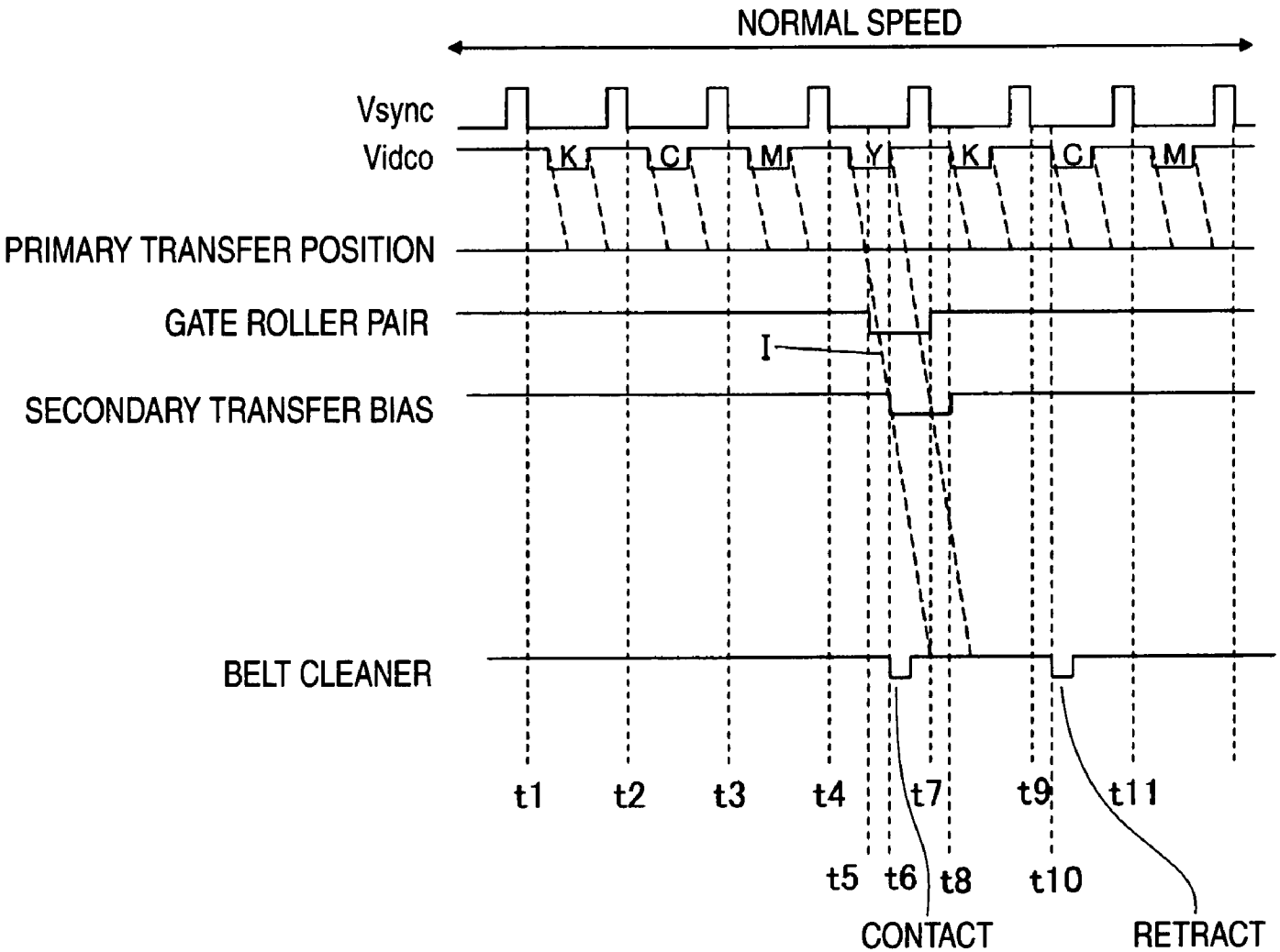
FIG. 4A is a timing chart showing operations of components in the main part when a recording medium is an ordinary sheet.
Figure 4B:
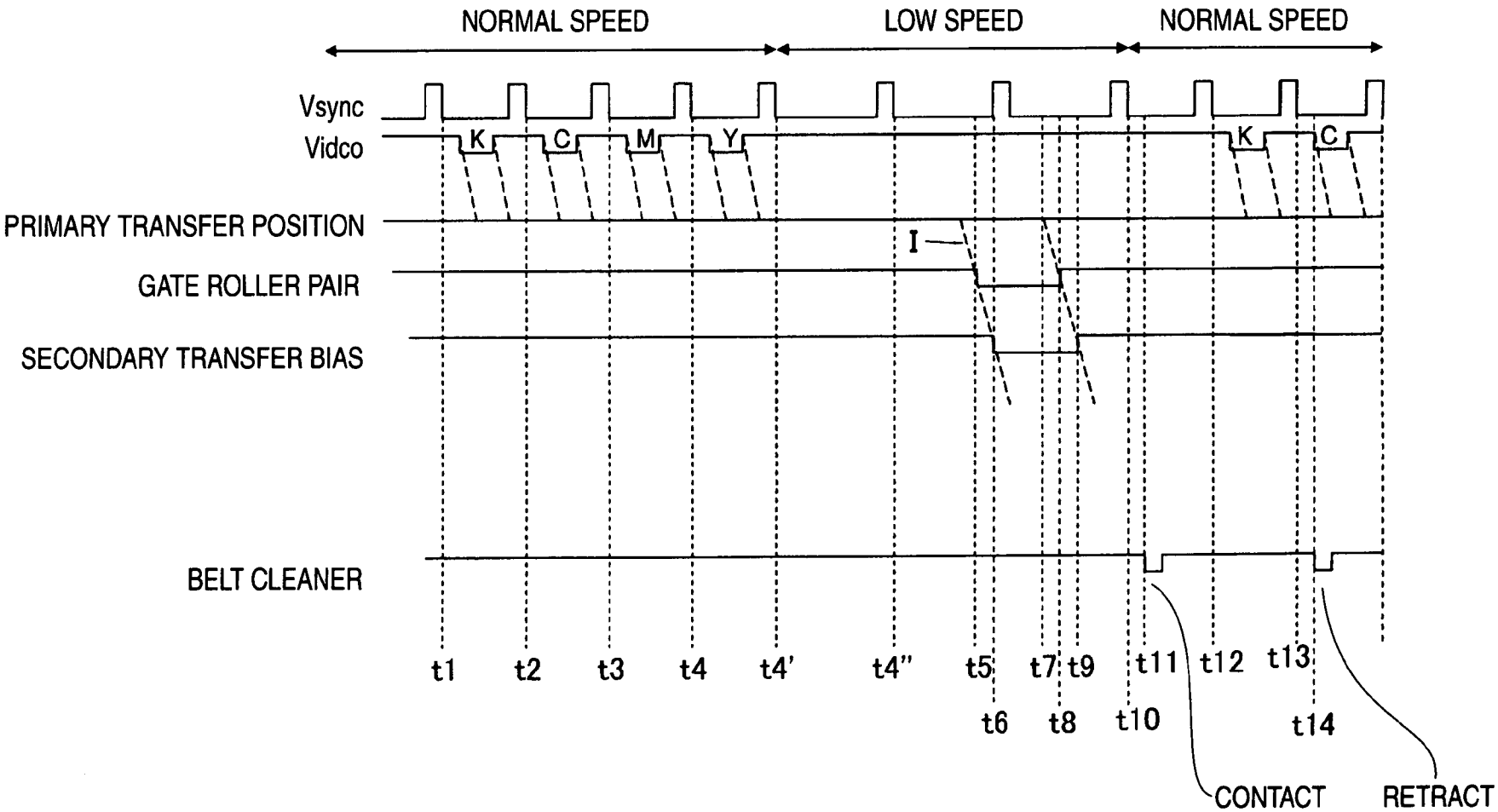
FIG. 4B is a timing chart showing operations of the components in the main part when a recording medium is a thick sheet.

FIGS. 4A and 4B are timing charts showing the operations of the main components shown in FIG. 2 controlled by the above-mentioned controller.

Here, "Vsync" indicates the ON/OFF state of a vertical synchronizing signal serving as a reference signal. "Video" indicates the ON/OFF state of an image writing (exposure) signal to the photosensitive body 21. "Gate roller" indicates the ON/OFF state of the driving of the gate roller pair 10*g*. "Secondary transfer bias" indicates the ON/OFF state of a secondary transfer bias at the secondary transfer position T2 and the contact/separate state of the secondary transfer roller 10*b* with respect to the intermediate transfer belt 51. "Belt cleaner" indicates the contact/separate state of the cleaning blade 81 with respect to the intermediate transfer belt 51.

In the reference signal of "Vsync," its ON state is defined as upward, while in the other signals, the ON state is defined as downward.

The reference signal is generated, for example, in the following configuration. A projection is provided in the side edge of the intermediate transfer belt 51, while a transmission type photo sensor is provided on the passing route of the projection. Then, when the projection intercepts the optical axis once per revolution of the intermediate transfer belt 51, an ON-OFF signal is generated and used as the reference signal.

The case that the recording medium S is an ordinary sheet will be described with reference to FIG. 4A.

With reference to time point t1 of OFF of a reference signal which is immediately before the latent image is written into the photosensitive body 21, a black (K) image is written after a predetermined time period has elapsed. Similarly, a cyan (C) image is written with reference to time point t2, while a magenta (M) image is written with reference to time point t3, and while a yellow (Y) image is written with reference to time point t4.

Further, with reference to the time point t4, the gate roller pair 10*g* is driven at time point t5, so that the recording medium S is conveyed toward the secondary transfer position T2 by the gate roller pair 10*g*. The timing t5 of driving the gate roller pair 10*g* is the timing of secondary transfer of the superposed image I of K, C, M, and Y onto a predetermined position of the recording medium S conveyed by the gate roller pair 10*g*.

At timing t6 which is immediately before the leading edge of the recording medium S reaches the secondary transfer position T2, the secondary transfer roller 10*b* is brought into contact with the intermediate transfer belt 51, while the secondary transfer bias is turned ON. By virtue of this, the superposed image I on the intermediate transfer belt 51 is transferred onto the recording medium S to perform the secondary transfer.

On the other hand, at the above-mentioned time point t6, the cleaning blade 81 is brought into contact with the intermediate transfer belt 51. The timing t6 is also the time point of completion of writing into the photosensitive body 21 the yellow (Y) image which is the fourth color image, and further is a time point immediately before the above-mentioned secondary transfer is started. However, this timing is in the time duration that the yellow (Y) image is under the primarily transfer. Thus, at the time that the cleaning blade 81 is brought into contact with the intermediate transfer belt 51, the yellow (Y) image which is the fourth color image has already been written into the photosensitive body 21, whereas the primary transfer of the yellow (Y) image is not completed.

After that, approximately at time point t7, a transfer remaining portion of the superposed image reaches the cleaning position of the cleaning blade 81, so that residual toner on the intermediate transfer belt 51 is removed.

Further, the time point t7 is also the timing of stopping the driving of the gate roller pair 10*g*.

After that, with reference to the time point t7, the write of a black (K) image for the next image is started at time point t8. Further, the secondary transfer roller 10*b* is separated from the intermediate transfer belt 51, while the secondary transfer bias is turned OFF.

After that, with reference to time point t9, the write of a cyan (C) image for the next image is started at time point t10, while the cleaning blade 81 is separated from the intermediate transfer belt 51.

Further, with reference to time point t11, a magenta (M) image is written. Then, the operation described above is repeated.

As seen from the description given above, when the recording medium S is an ordinary sheet, since the four color images can be formed at the same pitch in a successive manner, the number of achievable image formations per unit time can be maintained at high rate.

Next, the case that the recording medium S is a thick sheet will be described with reference to FIG. 4B.

Similarly to the case that the recording medium S is an ordinary sheet, with reference to time point t1 of OFF of a reference signal which is immediately before the latent image is written into the photosensitive body 21, a black (K) image is written after a predetermined time has elapsed. Similarly, a cyan (C) image is written with reference to time point t2, while a magenta (M) image is written with reference to time point t3, and while a yellow (Y) image is written with reference to time point t4.

Here, in the present embodiment, the operation goes into a low speed mode at the time point of a reference signal t4' which is after the completion of write of the yellow (Y) image. That is, when the recording medium S is a thick sheet, the circulating speed of the intermediate transfer belt 51 at the time of secondary transfer and the passing speed of the recording medium S caused by the fuser 60 are set to be slower than in the case that the recording medium is an ordinary sheet.

This is because heat capacity of a thick sheet is large. Namely, in order that the fusing of the toner image should reliably be performed onto the thick sheet, the heat generation rate of the fuser 60 need be increased, or alternatively, the speed of the recording medium S passing through the fuser 60 need be reduced such that the heat receiving rate should be increased in the recording medium.

In the present embodiment, the revolution speed of the fixing roller pair 61 (see FIG. 1) in the fuser 60 is set to be slower than (specifically, a half of) in the case that the recording paper is an ordinary sheet. Then, in accordance with this, the conveyance speed of the recording medium caused by the secondary transfer position T2 and the gate roller pair 10*g* is respectively set to be slower.

That is, in the present embodiment, the operation goes into the low speed mode at the time point of the reference signal t4' which is after the completion of write of the yellow (Y) image, so that the thick sheet is conveyed at the low speed so that the fusing of the toner image is reliably performed onto the thick sheet.

As a result, as shown in FIG. 4B, the pitch of the reference signals after t4' becomes twice that of FIG. 4A.

After that, with reference to time point t4", the gate roller pair 10*g* is driven at time point t5, so that the recording medium S is conveyed toward the secondary transfer position T2 by the gate roller pair 10*g*. The timing t5 of driving the gate roller pair 10*g* is the timing of secondary transfer of the superposed image I of K, C, M, and Y onto a predetermined position of the recording medium S conveyed by the gate roller pair 10*g*.

At timing t6 which is immediately before the leading edge of the recording medium S reaches the secondary transfer position T2, the secondary transfer roller 10*b* is brought into contact with the intermediate transfer belt 51, while the secondary transfer bias is turned ON. By virtue of this, the superposed image I on the intermediate transfer belt 51 is transferred onto the recording medium S to perform the secondary transfer.

Then, after the trailing edge of the superposed image I has passed the primary transfer position T1 at time point t7, the driving of the gate roller pair 10*g* is stopped at time point t8. Further, at time point t9, the secondary transfer roller 10*b* is separated from the intermediate transfer belt 51, while the secondary transfer bias is turned OFF.

After that, with reference to a reference signal t10, the above-mentioned low speed mode is canceled so that the operation goes into the normal mode. Thus, the intermediate transfer belt 51 and the like are driven at the normal speed (the speed in the case that the recording paper is an ordinary sheet). Further, with reference to the reference signal t10, the cleaning blade 81 is brought into contact with the intermediate transfer belt 51 at time point t11. The timing t11 is a time point that the primary transfer of the yellow image is completed, and is also a time point after the trailing edge of the superposed image I has passed the primary transfer position T1. Moreover, the timing t11 is a time point delayed from the time point t8 that the trailing edge of the recording medium S (thick sheet) has passed the nipping part N of the gate roller pair 10*g*, and further is a time point delayed from the time point t9 of completion of the secondary transfer.

Since the cleaning blade 81 is brought into contact with the intermediate transfer belt 51, a transfer remaining portion of the superposed image reaches the cleaning position so that residual toner on the intermediate transfer belt 51 is removed.

After that, with reference to time point t12, the write of a black (K) image for the next image is started. Then, with reference to time point t13, the write of a cyan (C) image for the next image is started at time point t14. After that, the operation described above (the operation in the case that the recording paper is an ordinary sheet or alternatively a thick sheet) is repeated.

With the above configurations, since the conveyance speed V1 of the recording medium S caused by the gate roller pair 10*g* is set to be faster than the conveyance speed V2 of the recording medium S at the secondary transfer position T2, no tension acts on the recording medium S between the gate roller pair 10*g* and the secondary transfer position T2. Thus, when the recording medium S has a thickness at or below that of an ordinary sheet (a sheet stiffness), the transfer operation at the secondary transfer position T2 becomes stable so that deviation or distortion does not occur in the image under the secondary transfer. Further, the traveling speed of the intermediate transfer member 51 also becomes stable so that deviation or distortion is avoided similarly in the image at the primary transfer position T1.

Further, when the recording medium S is a thick sheet, the cleaning blade 81 is brought into contact with the intermediate transfer member 51 after the primary transfer is completed. Accordingly, at the time that the cleaning blade 81 is brought into contact with the intermediate transfer member 51, the primary transfer is already completed.

Thus, even when the cleaning blade 81 is brought into contact with the intermediate transfer member 51, deviation or distortion hardly occurs in the image under the primary transfer at the primary transfer position T1.

Further, only when the recording medium S is a thick sheet, the speed of the intermediate transfer member 51 at the time of the secondary transfer and the passing speed of the recording medium caused by the fuser 60 are set to be slower than in the case that the recording medium is an ordinary sheet, while the cleaning blade 81 is brought into contact with the intermediate transfer member 51 after the primary transfer is completed. In contrast, when the recording medium S is an ordinary sheet, the cleaning blade 81 is brought into contact with the intermediate transfer member 51 at the normal speed before the primary transfer is completed. Thus, when the recording medium is an ordinary sheet, the number of achievable image formations per unit time can be maintained at a high rate.

Further, when the recording medium S is a thick sheet, the speed of the intermediate transfer member 51 at the time of secondary transfer and the passing speed of the recording medium caused by the fuser 60 become slower than in the case that the recording medium is an ordinary sheet. This permits reliable fusing of the toner image onto the thick sheet without the necessity of an increase in the heat generation rate of the fuser 60. Further, using the time duration that the recording medium S and the intermediate transfer member 51 are at low speeds, the cleaning blade 81 can be brought into contact with the intermediate transfer member 51 after the primary transfer is completed.

Further, when the recording medium S is a thick sheet, the cleaning blade 81 is brought into contact with the intermediate transfer member 51 after the trailing edge S2 of the recording medium S has passed the nipping part N of the gate roller pair 10*g*. Thus, at the time that the cleaning blade 81 is brought into contact with the intermediate transfer member 51, a state is already established that a speed increasing force resulting from a compressive force does not act on the intermediate transfer member 51. Accordingly, at the time that the cleaning blade 81 is brought into contact with the intermediate transfer member 51, the traveling speed of the intermediate transfer member 51 is in a stable state.

Thus, even when the cleaning blade 81 is brought into contact with the intermediate transfer member 51, no large fluctuation arises in the traveling speed of the intermediate transfer member 51. As a result, deviation or distortion hardly occurs in the image under the primary transfer at the primary transfer position T1.

Here, the heat generation rate of the fuser 60 may be increased, while the conveyance speed may be maintained at the normal speed even in the case of a thick sheet, and while a writing timing for the next image may be delayed. Then, the cleaning blade 81 may contact the intermediate transfer member 51 after the primary transfer is completed and/or after the trailing edge of the thick sheet has passed the nipping part of the gate roller pair 10*g*. Nevertheless, this causes the necessary of an increase in the heat generation rate of the fuser 60, and hence causes an increase in the power consumption.

In contrast, in this embodiment, in the case of a thick sheet, a low speed mode is used so that the cleaning blade 81 is brought into contact with the intermediate transfer member 51 after the primary transfer is completed and/or after the trailing edge of the thick sheet has passed the nipping part of the gate roller pair 10*g*. This permits reliable fusing of the toner image onto the thick sheet without the necessity of an increase in the heat generation rate of the fuser. Further, using the time duration that the recording medium S and the intermediate transfer member 51 are at low speeds, the cleaning blade 81 can be brought into contact with the intermediate transfer member 51 after the primary transfer is completed and/or after the trailing edge S2 of the recording medium S has passed the nipping part N of the gate roller pair 10*g*.

An embodiment of the present invention has been described above. However, the present invention is not limited to the above-mentioned embodiment, and can appropriately be modified and implemented within the scope of the spirit of the present invention.

What is claimed is:

1. An image forming apparatus, comprising:

an image carrier, adapted to support a toner image thereon;

a circulating intermediate transfer member, brought into contact with the image carrier to form a primary transfer position at which the toner image is transferred onto the intermediate transfer member to perform a primary transfer;

a secondary transfer member, brought into contact with the intermediate transfer member to form a secondary transfer position at which the toner image on the intermediate transfer member is transferred onto a recording medium passing therebetween, to perform a secondary transfer;

a gate roller pair, adapted to nip the recording medium therebetween at a nipping position and to convey the nipped recording medium toward the secondary transfer position; and a cleaning blade, retractably brought into contact with the intermediate transfer member to scrape off toner remaining on the intermediate transfer member, wherein:

a conveyance speed of the recording medium at the nipping position is faster than a conveyance speed of the recording medium at the secondary transfer position; and the cleaning blade is retracted from the intermediate transfer member until when a trailing end of the recording medium passes through the nipping position, in a case where the recording medium has a stiffness greater than a prescribed level.

2. The image forming apparatus as set forth in claim 1, wherein the cleaning blade is retracted from the intermediate transfer member until when the primary transfer is finished, in a case where the recording medium has a stiffness greater than the prescribed level.

3. The image forming apparatus as set forth in claim 1, further comprising a fuser, disposed at a fusing position and adapted to allow the recording medium on which the toner image has been transferred to pass through while fusing the toner image with the recording medium, wherein the circulating speed of the intermediate transfer member while the secondary transfer is performed and a conveyance speed of the recording medium at the fusing position are made lower, in a case where the recording medium has a stiffness greater than the prescribed level, than in a case where the recording medium has a stiffness no greater than the prescribed level.

4. An image forming apparatus, comprising:

an image carrier, adapted to support a toner image thereon;

a circulating intermediate transfer member, brought into contact with the image carrier to form a primary transfer position at which the toner image is transferred onto the intermediate transfer member to perform a primary transfer;

a secondary transfer member, brought into contact with the intermediate transfer member to form a secondary transfer position at which the toner image on the intermediate transfer member is transferred onto a recording medium passing therebetween, to perform a secondary transfer;

a gate roller pair, adapted to nip the recording medium therebetween at a nipping position and to convey the nipped recording medium toward the secondary transfer position; and a cleaning blade, retractably brought into contact with the intermediate transfer member to scrape off toner remaining on the intermediate transfer member, wherein:

a conveyance speed of the recording medium at the nipping position is faster than a conveyance speed of the recording medium at the secondary transfer position; and the cleaning blade is retracted from the intermediate transfer member until when the primary transfer is finished, only in a case where the recording medium has a stiffness greater than a prescribed level.

5. The image forming apparatus as set forth in claim 4, further comprising a fuser, disposed at a fusing position and adapted to allow the recording medium on which the toner image has been transferred to pass through while fusing the toner image with the recording medium, wherein the circulating speed of the intermediate transfer member while the secondary transfer is performed and a conveyance speed of the recording medium at the fusing position are made lower, only in a case where the recording medium has a stiffness greater than the prescribed level, than in a case where the recording medium has a stiffness no greater than the prescribed level.

* * * * *